US009821579B2

(12) United States Patent
Sim

(10) Patent No.: US 9,821,579 B2
(45) Date of Patent: Nov. 21, 2017

(54) PRINTER HAVING SAME COVER OPENING/CLOSING DIRECTION AS PAPER CUTTING DIRECTION

(71) Applicant: SEWOO TECH CO., LTD., Gyeonggi-do (KR)

(72) Inventor: Myeong Heum Sim, Seoul (KR)

(73) Assignee: SEWOO TECH CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/773,226

(22) PCT Filed: Aug. 4, 2015

(86) PCT No.: PCT/KR2015/008136

§ 371 (c)(1),
(2) Date: Sep. 4, 2015

(87) PCT Pub. No.: WO2016/153124

PCT Pub. Date: Sep. 29, 2016

(65) Prior Publication Data

US 2017/0043599 A1 Feb. 16, 2017

(30) Foreign Application Priority Data

Mar. 26, 2015 (KR) ..... 10-2015-0042633

(51) Int. Cl.

| | |
|---|---|
| ***B41J 11/70*** | (2006.01) |
| ***B41J 29/02*** | (2006.01) |
| ***B41J 2/32*** | (2006.01) |
| ***B41J 15/00*** | (2006.01) |
| ***B41J 15/04*** | (2006.01) |

(52) U.S. Cl.
CPC ..... *B41J 29/02* (2013.01); *B41J 2/32* (2013.01); *B41J 11/70* (2013.01); *B41J 15/00* (2013.01); *B41J 15/04* (2013.01)

(58) Field of Classification Search
CPC ..... B41J 2/32; B41J 11/70; B41J 15/00; B41J 15/04; B41J 29/02
See application file for complete search history.

(56) References Cited

U.S. PATENT DOCUMENTS

2009/0035044 A1 2/2009 Yoshioka

FOREIGN PATENT DOCUMENTS

| | | |
|---|---|---|
| JP | 2002167090 | 6/2002 |
| JP | 2002241005 | 8/2002 |
| JP | 2003034456 | 2/2003 |
| JP | 2014076514 | 5/2014 |
| KR | 2019950000806 | 1/1995 |
| KR | 100418055 | 1/2003 |

OTHER PUBLICATIONS

International Search Report cited in PCT Application No. PCT/KR2015/008136 dated Nov. 6, 2015.

*Primary Examiner* — Lamson Nguyen
(74) *Attorney, Agent, or Firm* — Workman Nydegger

(57) ABSTRACT

The present invention relates to a printer having the same cover opening/closing direction as the paper cutting direction, and includes: a housing in which a receiving space is formed, on an upper part of which a discharging port through which paper is discharged is formed, and which includes a cover that is openable/closable frontward; a cutting unit that is provided in the receiving space and cuts the paper discharged through the discharging port in the opening/closing direction of the cover; and a discharging unit for discharging the paper from the housing.

14 Claims, 6 Drawing Sheets

PRINTER HAVING SAME COVER OPENING/CLOSING DIRECTION AS PAPER CUTTING DIRECTION

TECHNICAL FIELD

The present invention relates to a printer, and more particularly, to a printer having the same cover opening/closing direction as a paper cutting direction in which the opening/closing direction of a cover disposed on a front of the printer is the same as a paper cutting direction of a cutting unit disposed inside the printer.

BACKGROUND ART

Generally, a printer is classified into a dot printer, a laser printer, and a thermal printer using thermal paper, wherein the thermal printer has been used recently in many fields. Here, the thermal printer is a kind of the printer in which the thermal paper is printed using a chemical reaction by heat emitted from a thermal print head (TPH) while the thermal paper passes by the thermal print head. In particular, the thermal printer has been used widely due to its simple internal structure and convenient portability. In the case of a general thermal printer a roll type-paper is used and the paper is housed in the printer.

Further, the paper housed in the printer is transferred and discharged outside the thermal printer when the paper is printed.

According to a printer of the prior art, it is common that the paper discharging direction is orientated upward and a cover of the printer is also opened/closed upward, and the paper discharging direction is orientated toward a front of the printer and the cover of the printer is also opened/closed frontward. Here, the paper may be jammed in the printer when the paper is drawn out, and at this time it is difficult to handle the jam of the paper since a cutting direction of a cutting unit inside the printer is perpendicular to the opening/closing direction of a cover of the printer.

Further, the gear portions for transferring a driving force to a roller portion for drawing out the paper are provided on the cover and the inside of the printer, respectively, so that the gear portions may be meshed each other and damaged.

DISCLOSURE

Technical Problem

The present invention has been proposed to solve the problems described above, and an object of the present invention is to provide a printer in which a paper cutting direction of a cutting unit inside the printer is to be identical to the opening/closing direction of a cover so that it is easy to handle the jammed paper.

Further, another object of the present invention is to provide a method for preventing the damage to the gear portion when the cover is opened/closed, by separating the gear portion and the roller portion from the cover.

The objects of the present invention are not limited to the objects described above, and other objects not described above will be obvious to the persons having an ordinary knowledge in this field from the following descriptions.

Technical Solution

According to an aspect of the present invention, there is provided a printer including: a housing in which a receiving space is formed, on an upper part of which a discharging port through which paper is discharged is formed, and which includes a cover that is openable/closable frontward; a cutting unit that is provided in the receiving space and cuts the paper discharged through the discharging port in the opening/closing direction of the cover; and a discharging unit for discharging the paper from the housing.

Here, the printer may further include a heat sensing print head provided inside the cover for inputting characters on the paper.

In addition, the discharging unit includes: a driving portion for generating the driving force; a gear portion that transmits the driving force from the driving portion and is provided independently from the cover; and a roller portion that draws out the paper from the housing using the driving force transmitted from the driving portion.

The cover is provided on a front of the printer, a hinge is provided on a lower part of the cover and the cover may include a stopper for defining the rotation range of the cover toward a front of the printer.

A hinge is provided on a lower part of the cover, and the cover may include a damper for controlling the opening/closing speed of the cover.

In this case, the cutting unit may be provided at a location corresponding to the area of the cover while the cover is closed.

Advantageous Effects

The printer having the same cover opening/closing direction as the paper cutting direction according to the present invention results in the following beneficial effects.

First, since a paper discharging port is disposed differently from the position of a cover, the paper cutting unit and the cover opening/closing directions are set to be identical and thus it is possible to minimize user's effort for removing jammed paper when the paper is jammed in the printer.

Second, according to the present invention it can prevent the failure of the gear portion by being meshed with the cover in advance when the cover of a printer is opened/closed.

The effects of the present invention are not limited to the effects described above, and other effects not described above will be obvious to the persons having an ordinary knowledge in this field from the following descriptions.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

BEST MODE FOR THE INVENTION

Exemplary embodiments of the present invention will be described below in more detail with reference to the accompanying drawings. However, it will be easily appreciated by those skilled in the art that the accompanying drawings are merely illustrated to more easily disclose the content of the present invention, but the scope of the present invention is not limited to the scope of the accompanying drawings.

The terms used herein are simply used to describe certain embodiments and are not intended to limit the present invention. Unless otherwise defined, singular expression includes plural expressions.

As used herein, terms such as "comprise" or "have" specify the presence of embodied features, numbers, steps, operations, elements, parts or a combination of them, and should be understood not to preclude presence or addition of one or more other features, numbers, steps, operations, components, parts or a combination of them.

Firstly, an embodiment of a printer having the same opening/closing direction of a cover 500 as the paper cutting direction will be described in detail referring to FIGS. 1 to 5.

Figure 1:
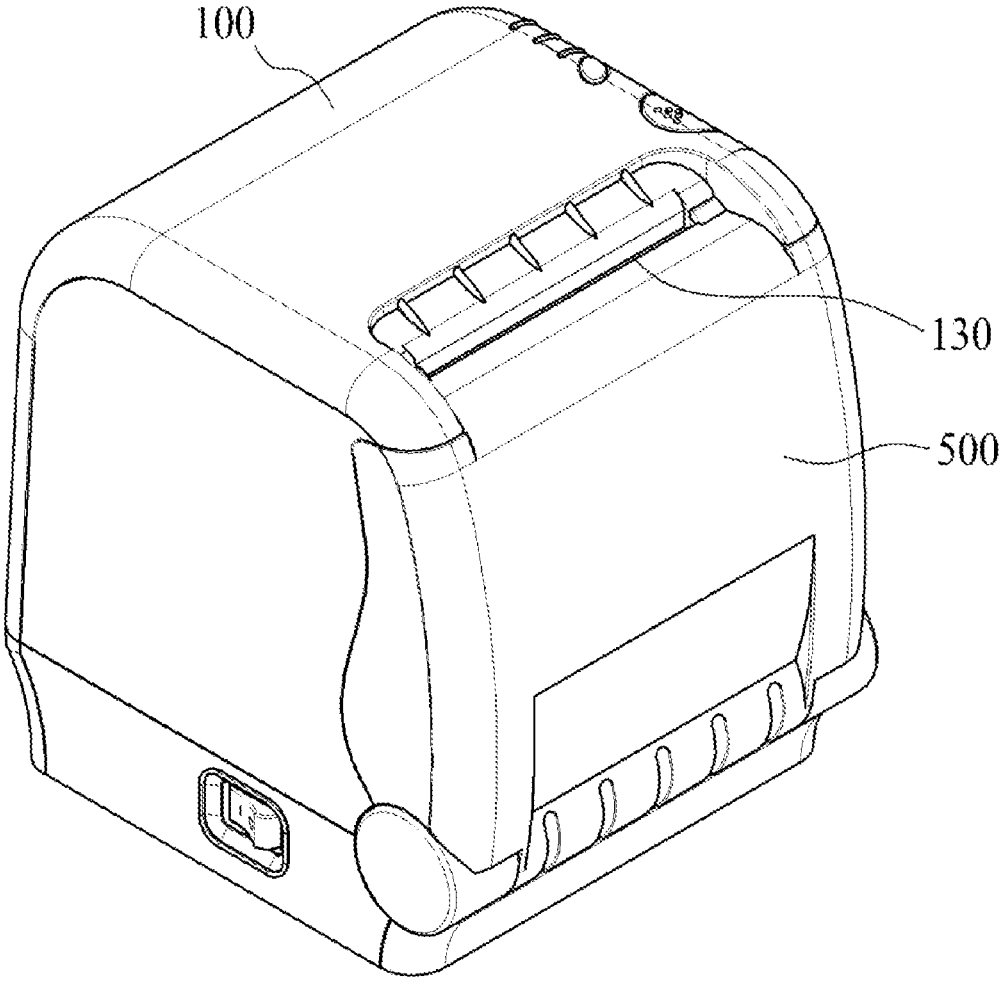
FIG. 1 is a perspective view illustrating a printer housing where a discharging portion is formed in a printer according to an embodiment of the present invention.
Figure 2:
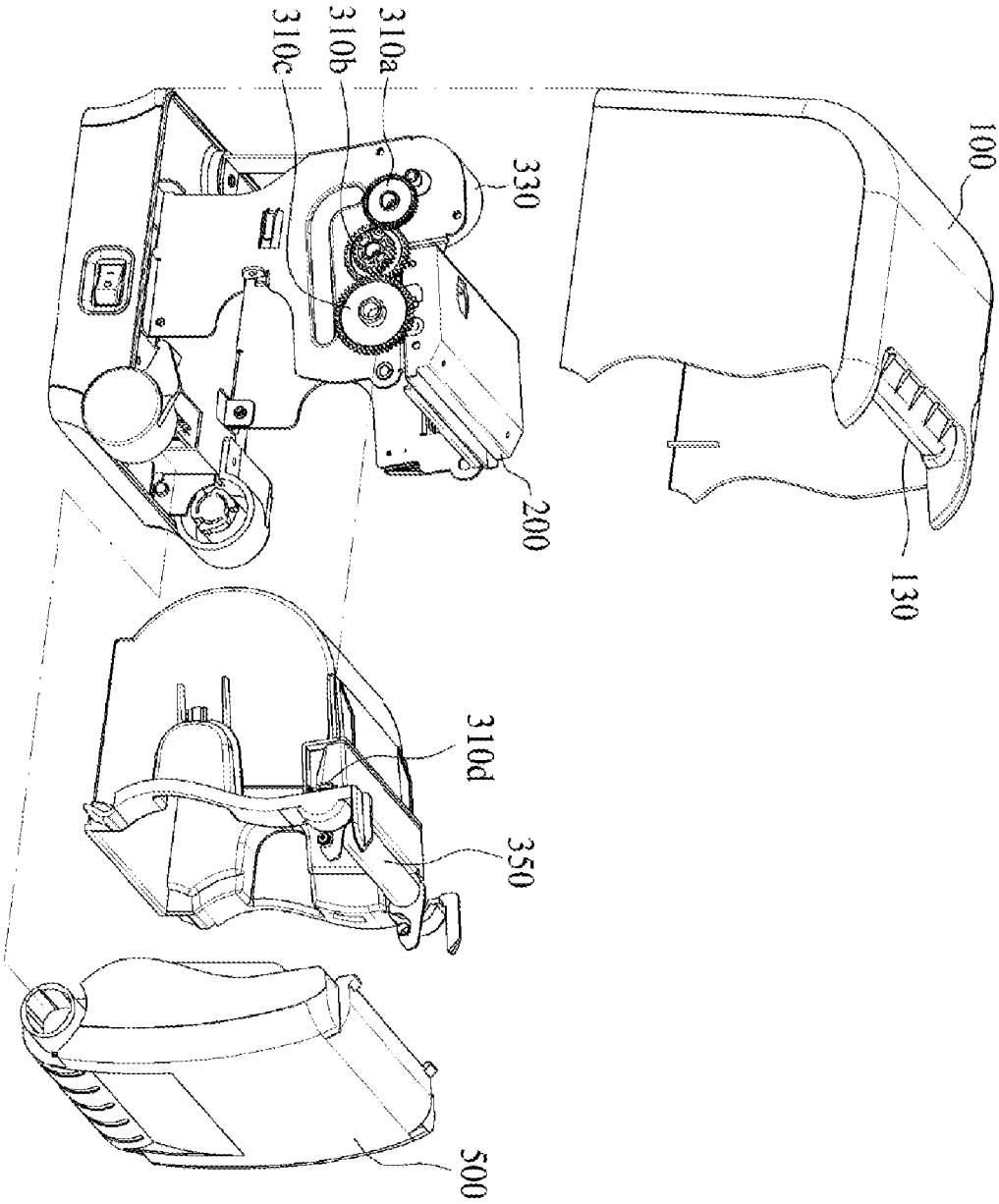
FIG. 2 is a perspective view illustrating the internal parts of a printer according to an embodiment of the present invention.
Figure 3:
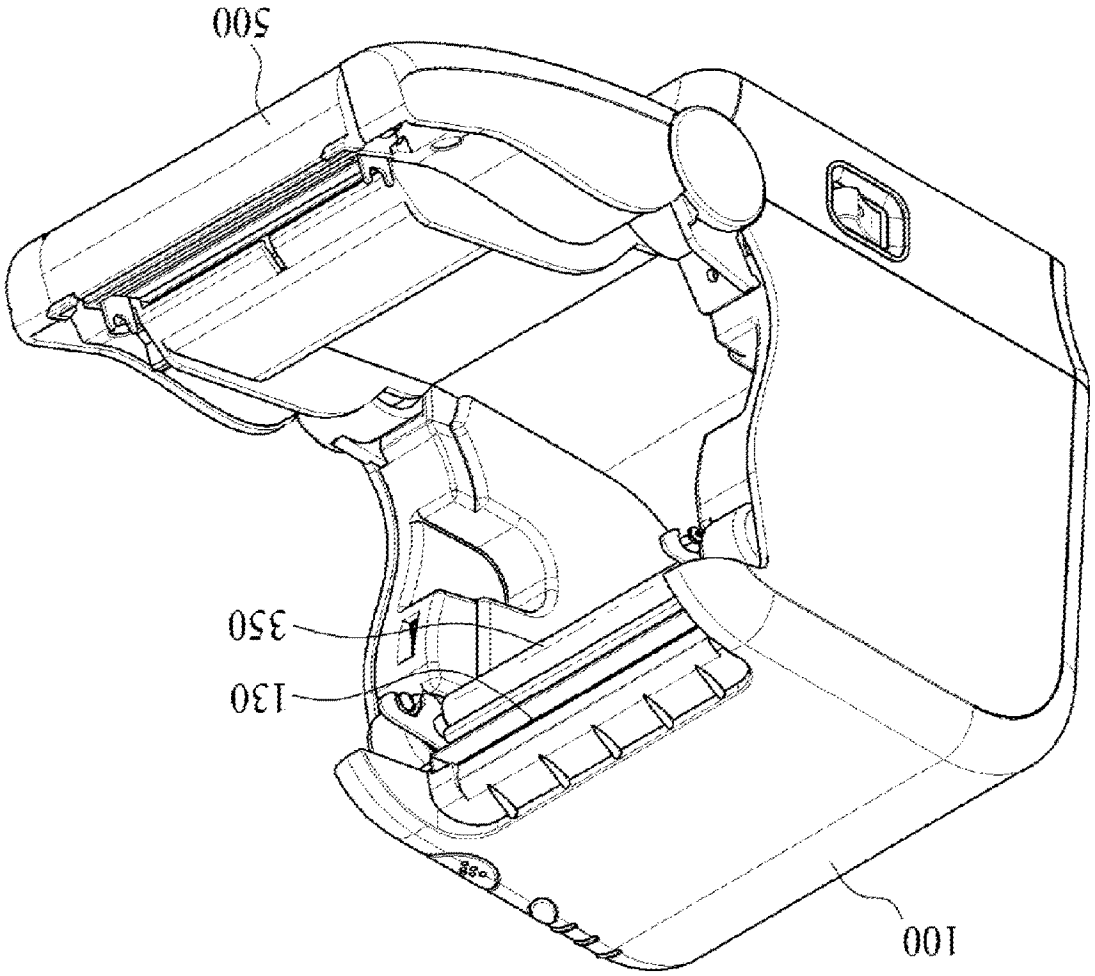
FIG. 3 is a perspective view illustrating a state where a cover is opened in the printer according to an embodiment of the present invention.
Figure 4:
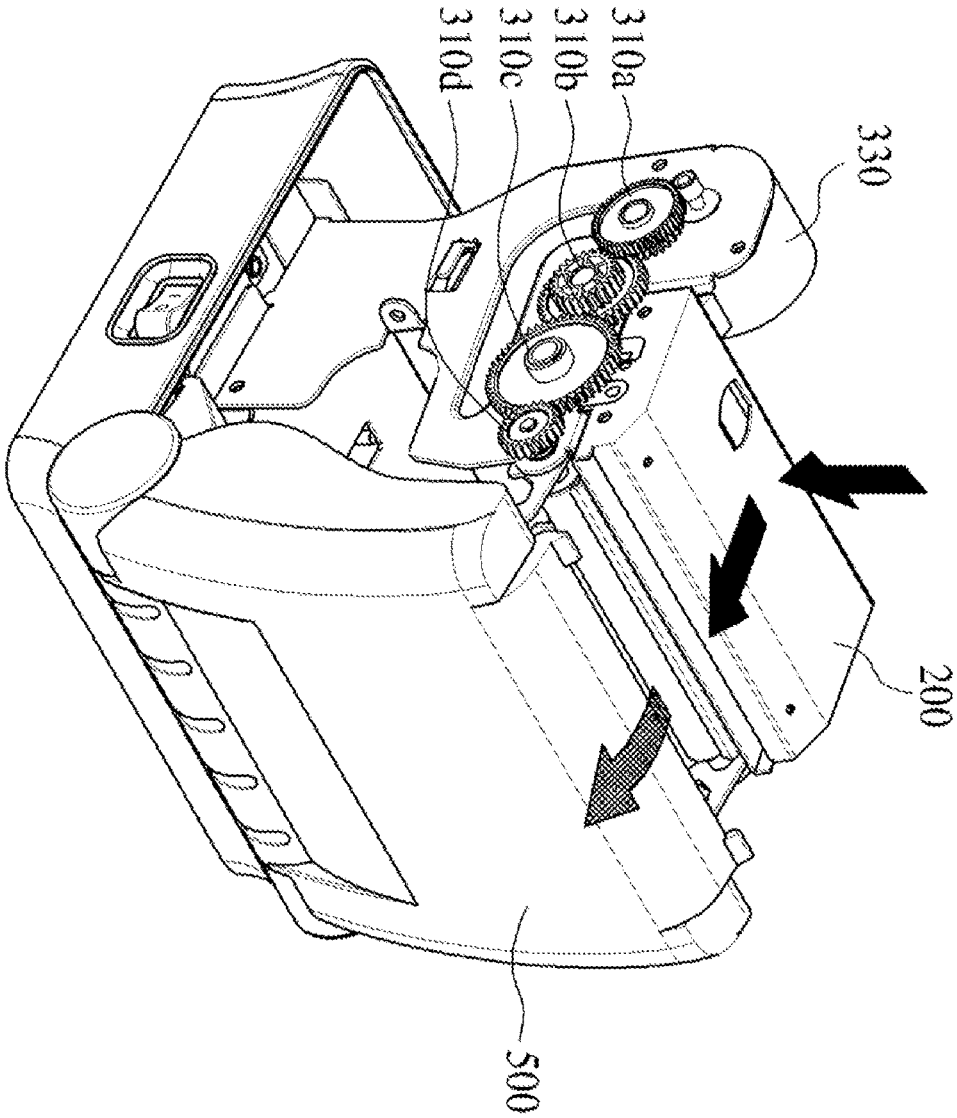
FIG. 4 is a perspective view illustrating a state where a cutting direction of a cutting unit provided in the housing is the same as an opening direction of a cover of a printer according to an embodiment of the present invention.
Figure 5:
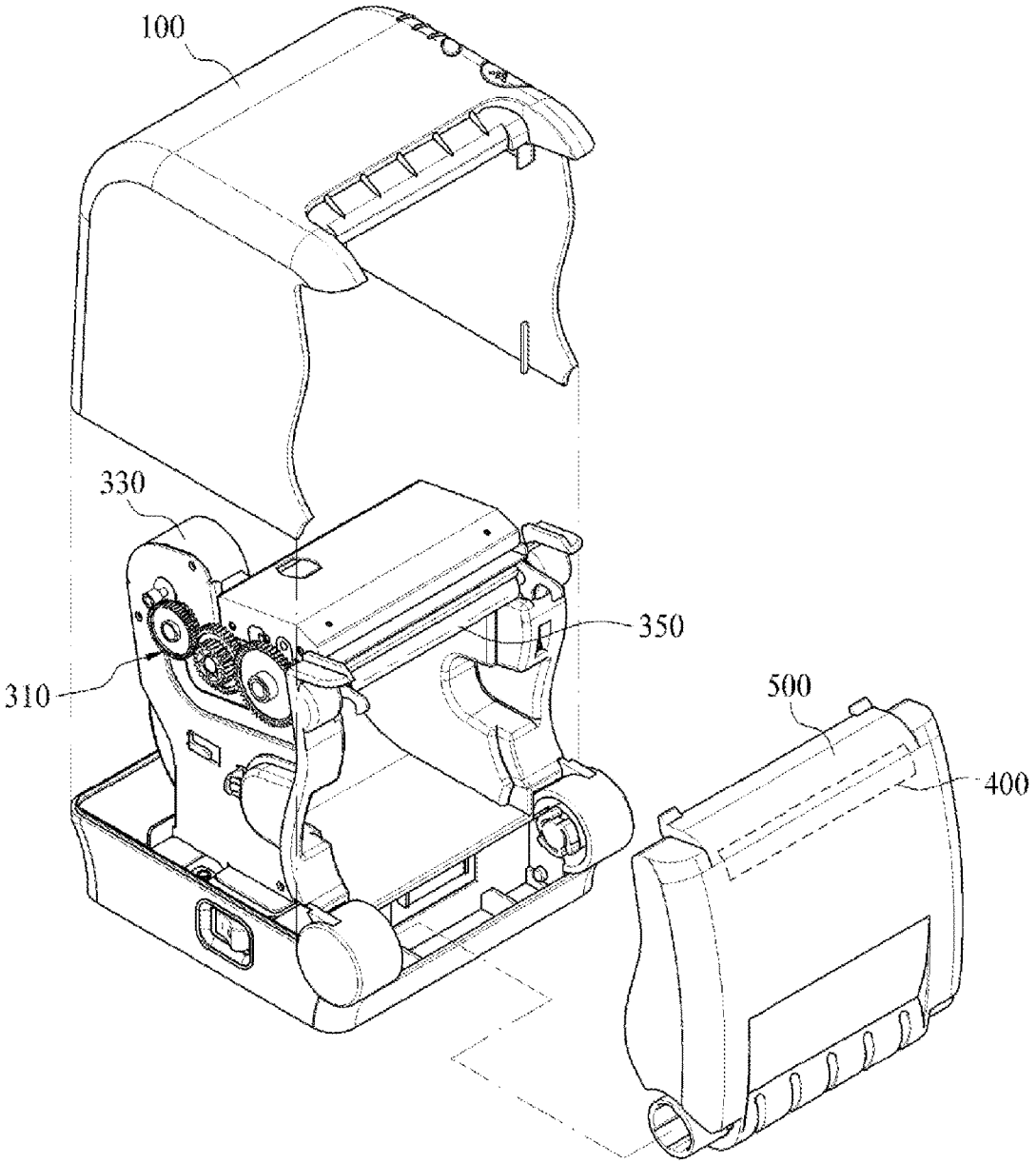
FIG. 5 is a perspective view illustrating a state where a discharging unit and a cutting unit including a driving portion, a gear portion, and a roller portion are separated from a cover inside the housing of a printer according to an embodiment of the present invention, and a state where a heat sensing print head is provided on the cover.

Here, FIG. 1 is a perspective view illustrating a printer housing where a discharging portion is formed in a printer according to an embodiment of the present invention, FIG. 2 is a perspective view illustrating the internal parts of a printer according to an embodiment of the present invention, FIG. 3 is a perspective view illustrating a state where a cover is opened in the printer according to an embodiment of the present invention, FIG. 4 is a perspective view illustrating a state where a cutting direction of a cutting unit provided in the housing is the same as an opening direction of a cover of a printer according to an embodiment of the present invention, and FIG. 5 is a perspective view illustrating a state where a discharging unit and a cutting unit including a driving portion, a gear portion, and a roller portion are separated from a cover inside the housing of a printer according to an embodiment of the present invention, and a state where a heat sensing print head is provided on the cover.

As shown in FIGS. 1 and 2, the printer having the same opening/closing direction of a cover 500 as the paper cutting direction according to an embodiment of the present invention may include a housing 100, a discharging port 130, a cutting unit 200, a discharging unit 300, and a cover 500.

In the present embodiment, the housing 100 has a predetermined size of a receiving space therein.

Here, the discharging port 130 through which paper can be discharged from the inside of the housing 100 is formed on an upper part of the housing 100.

The discharging port 130 formed on the housing 100 serves as an exit through which paper is discharged from the inside thereof and thus a width of the discharging port 130 may be formed wider than a width of the paper.

That is, a paper roll is provided inside the housing 100 and the paper may be drawn out through the discharging port 130 formed on an upper part of the printer.

Here, when the paper existing inside the housing 100 is drawn out through the discharging port 130, the paper is come out by a discharging unit 300 provided inside the housing 100, and the description thereof will be made later.

Meanwhile, the cutting unit 200 is arranged around the discharging port 130 within the housing 100 to be able to cut the paper when the paper is come out in a predetermined length.

The cutting unit 200 has a blade of a knife at a part thereof, which protrudes toward the cover 500, so that the paper may be cut while the paper is discharged through the discharging port 130.

At this time, the blade of a knife may have a saw tooth structure, and the shape and configuration may be varied without limitation.

Here, the direction of cutting the paper by the cutting unit 200 is set as a forward direction to which the cover 130 is opened/closed, and it is the same as the opening direction of the cover 500.

The configuration that the opening direction of the cover 500 is the same as the cutting direction of the cutting unit 200 will be described later.

In the present embodiment, the discharging unit 300 may include a gear portion 310, a driving portion 330, and a roller portion 350.

The driving force generated from the driving portion 330 that is provided inside the housing 100 is transmitted through the gear portion 310, the driving force transmitted through the gear portion 310 moves the roller portion 350, and the paper meshed with the roller portion is drawn out to the discharging port 130 through the rotation of the roller portion 350.

In detail, the rotation energy is generated from a drivable motor-type driving portion 330 and when a first gear 310*a* connected to the driving portion 330 is rotated, the gear tooth formed on the first gear 310*a* and the gear tooth formed on a second gear 310*b* and a third gear 310*c* are meshed to rotate, and also the gear tooth formed on a fourth gear 310*d* is also meshed to rotate and thus the paper is discharged through the discharging port 130.

As a result, the paper residing inside the housing 100 may be drawn out through the discharging port 130 by the discharging unit 300, and the paper drawn out through the discharging unit 300 is cut by the cutting unit 200.

Here, the number and shape of each respective gear portion are not limited. However, it shall be understood that the number and shape of the gear portion are set and formed enough to transmit the driving force generated from the driving portion 330 to the roller portion 350.

If all of the gear portions 310 of the discharging unit 300 are not provided inside the housing 100 and are provided on the cover 500 and the housing 100, respectively to transmit the driving force, there is a discomfort that the cover is to be opened/closed so that the gear portions 310 are meshed with each other whenever a user opens/closes the cover, and the gear teeth of the gear portions 310 formed on the cover 500 and housing 100, respectively are not meshed with each other, and thereby the gear portion 310 may be easily damaged. Accordingly, the gear portions 310 are provided inside the housing 100 to solve the problems described above.

Meanwhile, the material for the gear portion 310 provided inside the housing 100 may be varied.

According to an embodiment of a printer having the same cover opening/closing direction as the paper cutting direction, the cover 500 may be provided on a front of the printer and opened/closed frontward.

The operation of the cover 500 and constitutional elements thereof will be described in detail referring to FIGS. 3 and 4.

As described above, the opening direction of the cover 500 may be the same as the paper cutting direction by the cutting unit 200.

That is, the paper to be drawn out from the inside of the printer is cut through the cutting unit 200 provided on an internal upper part of the housing 100, wherein the direction of the external force required for cutting the paper may be the same as the opening direction of the cover 500.

According to a printer of a prior art, when the paper is discharged upward, the cover 500 is opened/closed upward, and when the paper is discharged frontward, the cover 500 is opened/closed frontward.

In the prior art, as the paper discharging direction is the same as the cover opening/closing direction, there is an inconvenience of directly handling the paper jammed between the paper and cover when cutting the paper by the cutting unit 200.

To reduce such an inconvenience, in the present invention, the cover 500 is provided on a front of a printer so that the opening/closing direction of the cover 500 is to be the same as the cutting direction of the cutting unit 200, thereby enabling a user to cope with the occurrence of jam more conveniently when the paper is jammed.

That is, according to the printer of the present invention, by making the cutting direction of the cutting unit 200 and the opening/closing direction of the cover 500 the same regardless of the discharging direction of the paper discharged from the printer, it is possible to rapidly remove the paper only by opening the cover 500 when the paper is jammed in the printer.

As a result, while the paper is cut by the cutting unit 200, if the paper is jammed between the cutting unit 200 and the discharging port 130, the paper is pulled out toward the opening direction of the cover 500 when the cover 500 is opened, thereby solving the paper jam.

By using the printer having the same opening/closing direction of the cover 500 as the paper cutting direction according to the present invention, including the configuration as described above, it is possible to achieve the effect of preventing the gear portion 310 from being damaged and more conveniently solving the paper jam when occurs. A heat sensing print head 400 may be provided on the cover 500 of the printer according to an embodiment of the present invention.

Here, when the print head 400 is used as the heat sensing print head, a heat sensing paper is used as a print paper, which refers to a method of inputting characters on the paper by a chemical reaction by heat emitted from the heat sensing print head 400 when the heat sensing paper passes by the heat sensing print head 400, characters may be input on the paper.

At this time, when a user closes the cover 500, the heat sensing print head 400 becomes adjacent to the roller portion 350 provided on the housing 100 and characters may be input on the paper while the paper passes by the heat sensing print head 400 by the roller portion 350.

That is, the heat sensing print head 400 is provided on the cover 500 that is openable/closable and provided on a front of the printer and the discharging unit 300 and the cutting unit 200 are provided inside the housing 100, thereby more easily coping with the paper jam when occurs and preventing the gear portion 310 from being damaged when the cover 500 is opened/closed.

Subsequently, a stopper and a damper provided on the cover 500 in a printer having the same opening/closing direction of the cover 500 as the paper cutting direction according to an embodiment of the present invention, will be described in detail.

Specifically, a hinge is provided on a lower part of the printer cover 500 to be able to be opened/closed. Therefore, an upper part of the cover 500 is spaced from the housing 100 of the printer and a lower part of the cover 500 is rotatably connected to the housing 100 such that the cover may be opened/closed.

Here, the opening/closing direction of the cover 500 and the constitutional element thereof are described above, and thus the detailed descriptions thereof will be omitted.

The cover 500 may have a configuration opened/closed frontward around the lower part thereof as an axis and in this case the stopper may define an opening/closing range of the cover 500.

For example, since it is possible to replace the paper inside the housing 100 or solve the paper jam while the upper part of the cover 500 is opened frontward around the hinge provided on a lower part of the cover 500 as an axis, it is not necessary to rotate at 360 degree the cover 500 around the hinge as an axis.

In other words, the extent necessary for the user, namely since the cover 500 needs only to open enough to see the cutting unit 200 residing at an upper part of the housing 100 using the printer, the stopper may be provided on the cover 500. Further, the stopper may define the movement of the cover 500 to prevent the cover 500 from being damaged due to the frequent opening/closing of the cover.

Further, according to an embodiment of the present invention, a damper may be provided on the cover 500. Therefore, as described above, a user may control the opening/closing speed of the cover 500 by using the damper unit, if necessary, when the cover 500 is opened/closed.

For example, a user may open the cover 500 when he/she replaces the paper inside the printer or the paper jam occurs, however when the cover 500 is opened at a high speed, the impact due to the high speed is applied to the hinge to causes damage to the cover.

Further, the damper may be provided for preventing a user from being injured due to an abrupt operation of the cover 500.

Subsequently, referring to FIG. 6, the cutting unit 200 in the printer having the same opening/closing direction of the cover 500 as the paper cutting direction according to an embodiment of the present invention will be described.

Figure 6:
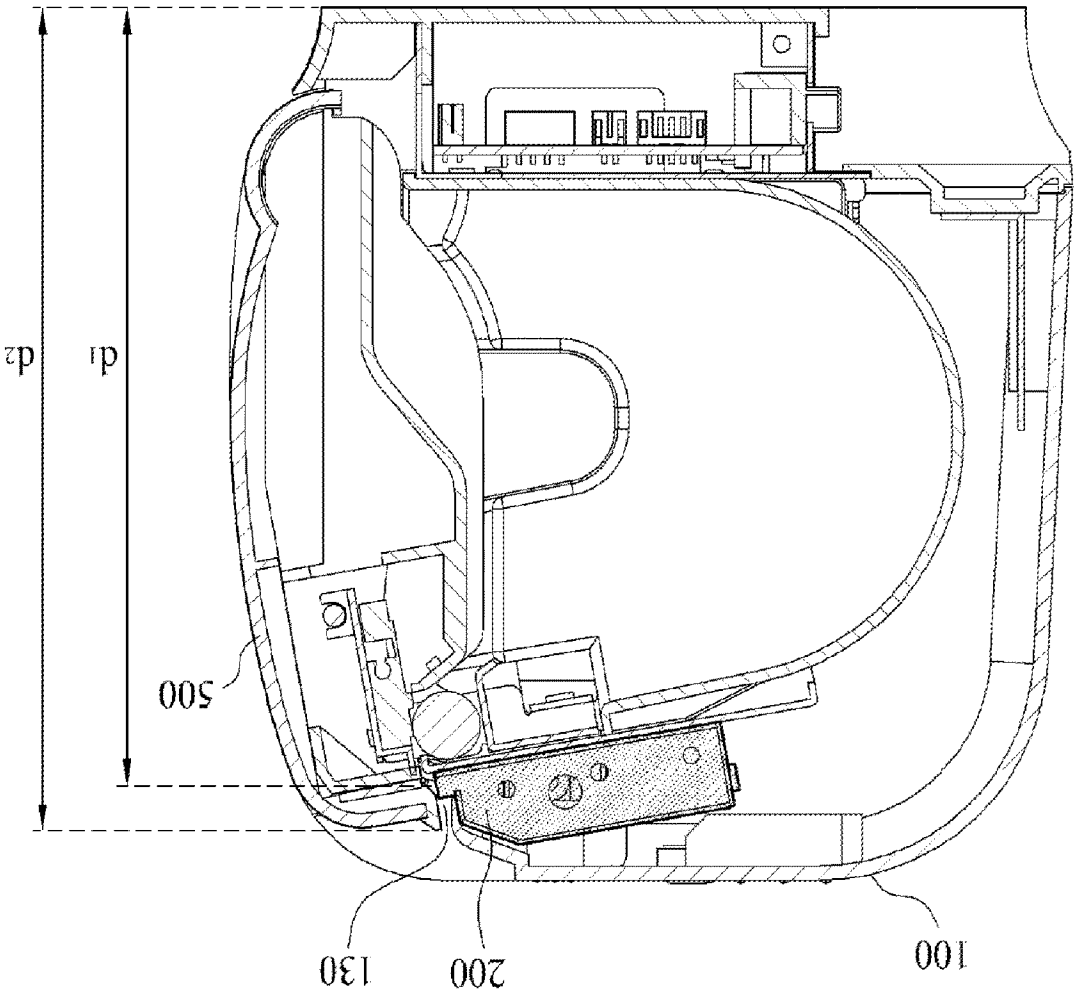
FIG. 6 is a perspective view illustrating a state where a cutting unit provided on the housing is disposed below the most-upper end of a cover disposed on a front of a printer according to an embodiment of the present invention.

FIG. 6 is a perspective view illustrating a state where a cutting unit 200 provided on the housing 100 is disposed below the most-upper end of the cover 500 when the cover 500 is opened, which is disposed on a front of a printer having the same opening/closing direction of the cover 500 as the paper cutting direction according to an embodiment of the present invention.

As shown in FIG. 6, the cutting unit 200 provided on the housing 100 may be disposed at a controllable height when a user opens the cover 500.

For example, if the cutting unit 200 is not disposed at the height controllable by a user, since there is a difficulty in handling the printer in which the paper jam occurs, the cutting unit 200 as described above may be disposed at the controllable height when a user opens the cover 500 in the printer while the paper jam occurs.

Accordingly, the cutting unit 200 may be provided on a location corresponding to the area of the cover 500 while the cover 500 is closed.

While the present invention has been described with respect to the specific embodiments, it will be apparent to those skilled in the art that various changes and modifications may be made without departing from the spirit and scope of the invention as defined in the following claims. Therefore, the described embodiments should be considered as being illustrative, not as being restrictive, whereby the present invention may be modified within the scope and the equivalent range of the appended claims.

The invention claimed is:

1. A printer comprising:

a housing in which a receiving space is formed, on an upper part of which a discharging port through which paper is discharged is formed, and which includes a cover that is openable/closable frontward;

a cutting unit that is provided in the receiving space and cuts the paper discharged through the discharging port in the opening/closing direction of the cover;

a discharging unit for discharging the paper from the housing; and a heat sensing print head provided inside the cover for inputting characters on the paper.

2. The printer of claim 1, wherein the discharging unit comprises:

a driving portion for generating a driving force;

a gear portion that transmits the driving force from the driving portion and is provided independently from the cover; and a roller portion that draws out the paper from the housing using the driving force transmitted from the gear portion.

3. The printer of claim 1, wherein a hinge is provided on a lower part of the cover and the cover includes a stopper for defining a rotation range of the cover to a front of the printer.

4. The printer of claim 1, wherein a hinge is provided on a lower part of the cover and the cover includes a damper for controlling an opening/closing speed of the cover.

5. The printer of claim 1, wherein the cutting unit is provided at a location corresponding to the area of the cover while the cover is closed.

6. A printer comprising:

a housing in which a receiving space is formed, on an upper part of which a discharging port through which paper is discharged is formed, and which includes a cover that is openable/closable frontward;

a cutting unit that is provided in the receiving space and cuts the paper discharged through the discharging port in the opening/closing direction of the cover; and a discharging unit for discharging the paper from the housing, the discharging unit comprising:

a driving portion for generating a driving force;

a gear portion that transmits the driving force from the driving portion and is provided independently from the cover; and a roller portion that draws out the paper from the housing using the driving force transmitted from the gear portion.

7. The printer of claim 6, further comprising a heat sensing print head.

8. The printer of claim 6, wherein a hinge is provided on a lower part of the cover and the cover includes a stopper for defining a rotation range of the cover to a front of the printer.

9. The printer of claim 6, wherein a hinge is provided on a lower part of the cover and the cover includes a damper for controlling an opening/closing speed of the cover.

10. The printer of claim 6, wherein the cutting unit is provided at a location corresponding to the area of the cover while the cover is closed.

11. A printer comprising:

a housing in which a receiving space is formed, on an upper part of which a discharging port through which paper is discharged is formed, and which includes a cover that is openable/closable frontward;

a cutting unit that is provided in the receiving space and cuts the paper discharged through the discharging port in the opening/closing direction of the cover; and a discharging unit for discharging the paper from the housing, wherein the cover includes a hinge provided on a lower part of the cover, the cover further including at least of:

a stopper for defining a rotation range of the cover to a front of the printer, or a damper for controlling an opening/closing speed of the cover.

12. The printer of claim 11, further comprising a heat sensing print head.

13. The printer of claim 11, wherein the discharging unit comprises:

a driving portion for generating a driving force;

a gear portion that transmits the driving force from the driving portion and is provided independently from the cover; and a roller portion that draws out the paper from the housing using the driving force transmitted from the gear portion.

14. The printer of claim 11, wherein the cutting unit is provided at a location corresponding to the area of the cover while the cover is closed.

* * * * *